United States Patent [19]

Sakow

[11] 4,164,796

[45] Aug. 21, 1979

[54] SINK STRAINER ASSEMBLY

[76] Inventor: Lawrence Sakow, 2417 Delancy Pl., Philadelphia, Pa. 19103

[21] Appl. No.: 839,426

[22] Filed: Oct. 5, 1977

[51] Int. Cl.[2] ..... E03C 1/26; A47K 1/14

[52] U.S. Cl. ..... 4/288; 4/286

[58] Field of Search ..... 4/286, 287, 289, 290, 4/291, 189, 190, 191

[56] References Cited

U.S. PATENT DOCUMENTS

| | | | |
|---|---|---|---|
| 989,410 | 4/1911 | Peters | 4/291 |
| 1,599,887 | 9/1926 | Grigg | 4/290 |
| 2,090,299 | 8/1937 | Kuhnle | 4/287 |
| 2,233,234 | 2/1941 | Wilson | 4/291 |
| 2,440,165 | 4/1948 | Behrend | 4/190 |
| 3,457,570 | 7/1969 | Williams | 4/190 |

FOREIGN PATENT DOCUMENTS

| | | | |
|---|---|---|---|
| 1408884 | 10/1975 | United Kingdom | 4/288 |

*Primary Examiner*—Henry K. Artis

*Attorney, Agent, or Firm*—Weiser, Stapler & Spivak

[57] ABSTRACT

A sink strainer assembly includes a hollow strainer body, a molded hollow plastic nipple which is a force fit within a lower hub section of the strainer body and a filtering screen assembled to the nipple in the hub section of the strainer body to prevent oversized materials from passing into drainage conduits connected to the strainer assembly. In the method of this invention, the strainer body is formed from stainless strip by a deep drawing operation, and the filtering screen is cut, stamped or otherwise separated from the base of the lower hub section. This separation can occur as part of a progressive die or as a separate operation.

9 Claims, 5 Drawing Figures

SINK STRAINER ASSEMBLY

BACKGROUND OF THE INVENTION

This invention relates to a sink strainer assembly and its method of manufacture. Reference throughout this application to "sink" is intended to include all types of sinks, basins and tubs that are conventionally connected through suitable plumbing to convey liquids to a drainage area.

Sink strainer assemblies generally include a one piece body that is attached to the sink by a locknut from the underside of the sink which makes up with matching threads formed on the strainer body. To achieve a tight seal, putty is applied under the flange of the body which hardens into a cement-like substance.

There are basically four types of strainers available.

Type One—is a one piece molded plastic body with a stainless steel flange attached to the flange or upper part of the molded strainer. This is done for appearance and to protect the most vulnerable area of the strainer from the wear and tear associated with sink use.

Type Two—is a one piece deep drawn hollow body made from heavy gauge (0.050" to 0.060") brass or stainless steel strip. The threads are cut into the body.

Type Three—is a deep drawn hollow body made from light gauge (0.025" to 0.035") stainless steel strip. This type of body utilizes a roll thread for make up to the sink and attachment to drain connection.

Type Four—is a molded plastic body with molded external threads for make up to sink and connection to drain. An internal liner of thin wall, deep drawn stainless steel is force fit into the entire inside of the strainer.

The advantages and disadvantages of the prior art sink strainer assemblies can be summarized as follows:

| | Advantages | Disadvantages |
|---|---|---|
| Type 1 | Low Cost | Special wrench needed needed for 3⅜" locknut. Plastic tends to discolor and does not hold up under wear and tear of sink use. Also standard putty deteriorates plastic. |
| Type 2 | High Quality | Special wrench needed for make up. In brass, chrome plating tends to wear ayay. |
| Type 3 | Low Cost | Roll threads trap food particles and therefore unsanitary condition exists. |
| Type 4 | Low Cost | Putty will attack and deteriorate plastic. Small drain opening will reduce drainage. Fit-all replacement basket will not fit the body. |

SUMMARY OF THE INVENTION

In accordance with this invention, the sink strainer assembly includes a one piece metal sink strainer body and a lower hollow hub section. A hollow nipple, preferably of plastic, is inserted within the hub section, and is force-fit into liquid-tight engagement with a lower surface of the hub section. The lower end of the nipple is molded to provide threads to receive a suitable threaded coupling to connect the strainer assembly to the plumbing system and to provide for a locknut to attach the assembly to the sink (not shown). In the preferred construction of this invention, a filtering screen is positioned on an upper surface of the nipple within the hollow hub section to intercept the flow of solids passing through the strainer assembly. Most preferably, locking tabs are provided to overlie the upper surface of the nipple. These locking tabs are desirably formed as upstanding members spaced about the periphery of, and forming a part of, the nipple.

In accordance with the method of this invention the strainer body is formed from a sheet metal blank (e.g. stainless steel) in a conventional metal deforming and cutting operation, and the metal sheet or disc employed to form the filtering screen is formed from a section of the blank. Specifically the disc employed to form the filtering screen is stamped from the region of the sheet metal blank that would otherwise form a lower wall or base of the hub section. This lower wall must be removed to permit liquids to pass through the assembly.

Most preferably, the filtering disc is cut from the base of the hub section to leave an inturned lip. This lip cooperates with the outer surface of the plastic nipple to provide the liquid-tight, force-fit connection between the strainer body and nipple. The lip prevents the upper nipple from being pushed through the hole during assembly.

Other objects and advantages of this invention will become apparent by referring to the detailed description which follows, taken in conjunction with the drawings wherein like reference characters refer to similar parts throughout the several views and in which:

DESCRIPTION OF THE PREFERRED EMBODIMENT OF THE INVENTION

Figure 1:
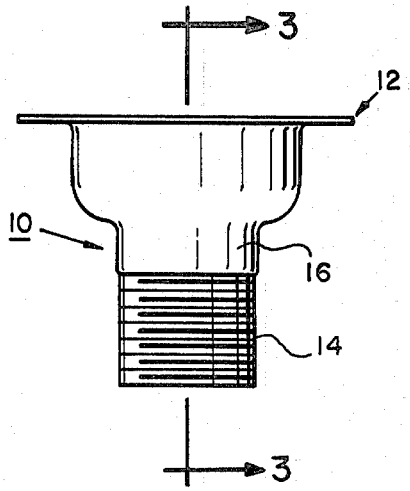
FIG. 1 is a elevation view of the sink strainer assembly in accordance with this invention.
Figure 3:
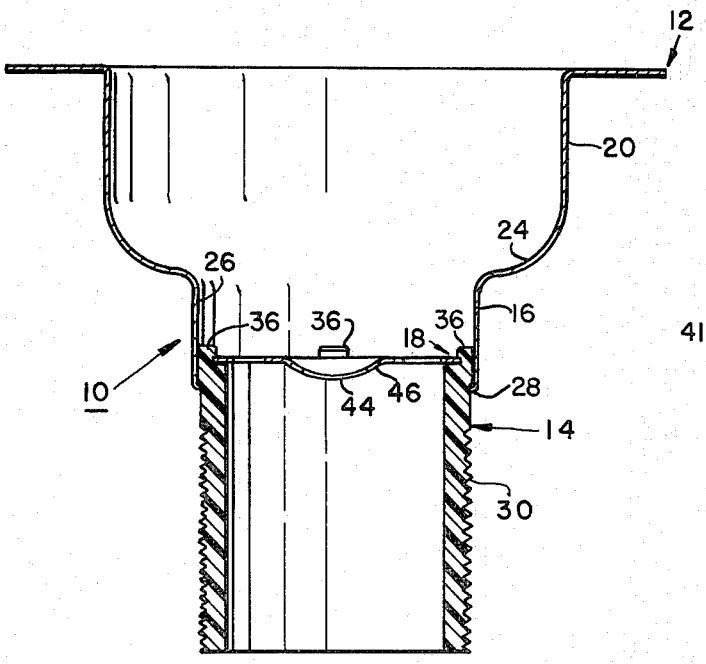
FIG. 3 is an enlarged sectional view taken along line 3—3 of FIGS. 1 and 2.

Referring to FIGS. 1 and 3, the sink strainer assembly 10 in accordance with this invention includes a hollow strainer body 12, a hollow nipple 14 secured within the lower hollow base section 16 of the strainer body, and a filtering screen 18 retained within the base section to intercept the flow of solids and other materials directed through the strainer assembly.

Figure 2:
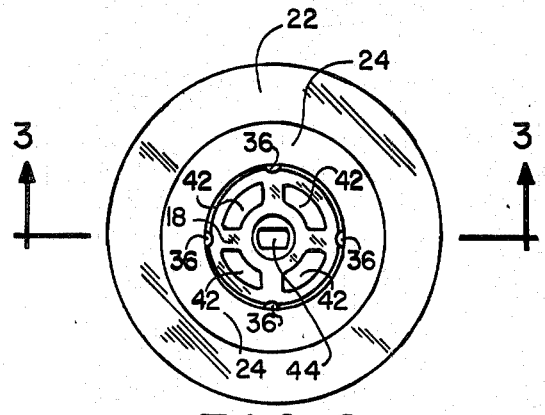
FIG. 2 is a plan view of the assembly.
Figure 5:
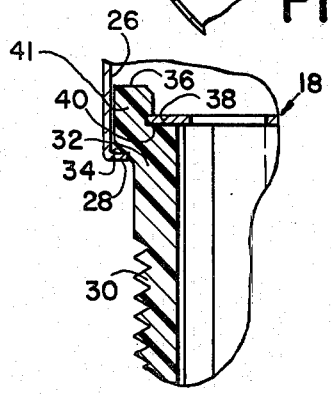
FIG. 5 is an enlarged, partial view, in elevation, of a region of the assembly including one of the locking tabs.

Referring to FIGS. 2, 3 and 5, the strainer body 12 includes an upper recessed, or dish-shaped section 20 having an outwardly extending flange 22 adjacent the upper end thereof. The flange is adapted to be positioned in overlying relationship with the waste opening of a sink (not shown), and fastened to the sink by an adhesive putty and locknut (also not shown) in a conventional manner. The upper section 20 includes a bottom wall 24 that forms a continuous extension of the interior wall 26 of the hollow base section 16. An inturned lip 28 is provided at the lower terminus of the base section, and the function of this lip will be described in detail hereinafter.

The upper section of the nipple 14 is 0.008 to 0.010 inches larger in diameter than the base section 16 of the hollow body 10. The nipple is inserted through the hole in the bottom of the base 10 and the upper section 41 of the nipple is forced by hydraulic or air pressure into the base of the hollow body. The internal lip 28 acts as both an aid in sealing and also as a positive stop to prevent the nipple from being pushed through the hole.

In view of the dimensional relationship between the strainer body and the nipple, the lower threaded section 30 of the nipple can be moved past the inturned lip 28 in a relatively easy manner without damaging the threads. Upon the application of sufficient force, the plastic nipple 14 will come to rest with the lower area of its inclined section 34 engaging the inturned lip 28 of the strainer body 12. The relative dimensions of the parts provide a force-fit, liquid-tight seal between the strainer body 12 and the nipple 14. The upper section of the plastic nipple is 0.008 to 0.010 inches larger than the inner diameter of the hub or base section 16. It should be understood that other arrangements can be employed to form a force-fit, liquid-tight connection between the strainer body and and the nipple. For example, the inturned lip 28 at the lower end of the hub section 16 could be replaced by a thickened continuous bead that would provide substantially the identical function as the inturned lip.

Referring now to FIGS. 2–5, it will be observed that the hollow nipple 14 also includes four identical locking tabs 36 (FIG. 2) extending upwardly beyond an upper supporting surface 38 of the upper head section 32. Each of the locking tabs 36 is undercut at 40 adjacent the upper support surface 38 to provide a groove that aids in locking the filtering screen 18 into the assembly, in a manner which will be described in detail hereinafter.

Figure 4:
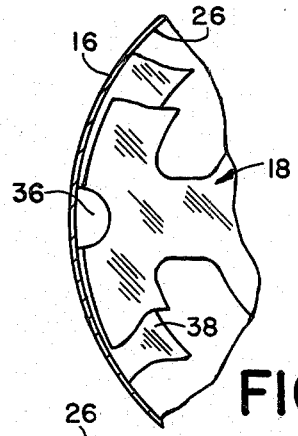
FIG. 4 is an enlarged, partial view, in plan, of a region of the assembly.

As best seen in FIGS. 2, 3 and 4, the filtering screen 18 includes a series of peripheral openings 42. In addition the screen includes an elongate opening 44 in a central recessed section 46. This construction permits a stopper (not shown) to be easily positioned relative to the base 16 in either an open condition, to permit liquid materials to pass through the strainer assembly 10, or a closed condition, to block the openings through the strainer assembly to prevent the passage of materials. Specifically, the stopper should be provided with a downwardly extending stem having generally the same cross sectional configuration as the elongate central opening 44 in the screen 18. When the long dimension of the stem is aligned with the long dimension of the opening 44 it will enter the opening, and the lower surface of the stopper can seal against the bottom wall 24 or base section 16. By rotating the stopper through ninety degrees so that the long dimension of the stem is in a different orientation relative to the long dimension of the opening 44, the stem will be elevated to support the stopper above sealing position. This will raise the stopper and prevent it from sealing the peripheral openings 42 in the filtering disc 18.

In the preferred embodiment of this invention the filtering screen, or disc 18 is formed from a piece of metal that is cut, or stamped from the same sheet metal blank used to form the hollow strainer body 12. Specifically, a metal deforming operation is employed to form the shaped strainer body 12 from a substantially flat sheet of metal, preferably stainless steel. At the end of the forming operation, the base of the hub is cut, punched, or otherwise separated from the remainder of the blank to simultaneously form the inturned lip 28 and a circular disc employed to form the filtering screen 18. This provides for extremely efficient use of materials.

Referring now to FIGS. 2–5, it will be observed that the filtering screen 18 is maintained in its desired position within the assembly 10 by positioning its lower surface in engagement with the upper support surface 38 of the head section 32 of the plastic nipple 14.

The marginal edge of the filtering screen 18 is positioned within the undercut grooves 40 in the locking tabs 36 and the locking tabs are maintained in engagement with the marginal edge of the screen by confining the tabs 36 with the interior wall 26 of the base section 16. Most preferably, the outer section of the nipple in the region constituting each tab is in engagement with, or positioned close to, the interior surface 26 of the base to prevent the tabs from moving outwardly and disengaging the filtering screen 18. The outside diameter defined by the tabs is larger preferably by approximately 0.008 to 0.010 inches than the inner diameter of the bottom base section 16. As the nipple and the screen or strainer are force fit into the bottom section 16, the stainless steel bottom section maintains its dimension while the molded nipple is forced inwardly. This action holds the strainer two ways—the undercut part 40 of each tab 36 is forced into the edge of the strainer and the upper part 41 of each tab 36 is pushed over the screen 18 to lock it in place.

The locking tabs 36 in addition to securing the screen 18 in position are also useful in installation to prevent the unit from turning while tightening the nut (not shown) upon the nipple threaded section 30. The entire assembly results in a low cost, strong, easily assembled unit that will not deform and which will provide long periods of trouble-free use.

What is claimed is:

1. A sink strainer assembly adapted to be fastened within a sink for passing materials through the sink to a drainage area, said assembly including:

a hollow, metallic strainer body including a hollow hub section at its lower end;

a hollow, plastic nipple having an upper head section and a lower threaded section, said nipple being in a force-fit, liquid-tight relationship within said hub section with the lower threaded section of the nipple extending beyond the end of the hub section for receiving a threaded coupling;

a filtering screen having openings therethrough, said screen being positioned on the upper surface of the head section of the nipple to intercept the flow of solids through the assembly; and locking means for engaging said screen to retain it on the upper surface of the head of the nipple, the locking means including a plurality of tabs spaced about the periphery of the nipple and forming a part of said nipple, said tabs extending above the upper surface of the screen and being in contact with the screen.

2. The sink strainer assembly of claim 1 wherein at least some of the tabs are undercut to receive a margin of the screen to retain the screen upon the upper surface of the head of the nipple.

3. A sink strainer assembly adapted to be fastened within a sink for passing materials through the sink to a drainage area, said assembly including:

a hollow, metallic strainer body including a hollow hub section at its lower end;

a hollow plastic nipple having an upper head section and a lower threaded section, said nipple being in a force-fit, liquid-tight relationship within said hub section with the lower threaded section of the nipple extending beyond the end of the hub section for receiving a threaded coupling;

a filtering screen having openings therethrough, said screen being positioned on the upper surface of the head section of the nipple to intercept the flow of solids through the assembly; and locking means for engaging said screen to retain it on the upper surface of the head of the nipple, the locking means including a plurality of tabs spaced about the periphery of the nipple and forming a part of said nipple, said tabs extending above the upper surface of the screen and being undercut to receive a margin of said screen to retain it on the upper surface of the head of the nipple.

4. The sink strainer assembly of claim 3 wherein the outer periphery of each tab is close to the interior wall of the hub section to prevent each tab from moving out of its locking engagement with the filtering screen.

5. The sink strainer assembly of claim 3 wherein the upper head section of the nipple has a greater outer diameter than the interior diameter of a lower end of the hub section, wherein the lower threaded section of said nipple has substantially the same or lesser outside diameter than the interior diameter of the lower end of the hub section, and a transition section joining the outer periphery of the lower threaded section to the outer periphery of the upper head section, said transition section being in force-fit, liquid-tight engagement with the lower section of the hub to provide the force-fit, liquid-tight seal.

6. The sink strainer assembly of claim 3 wherein said hollow hub has an interior surface that is free of threads.

7. The sink strainer assembly of claim 3 wherein the filtering screen is provided by a disc member cut from the strainer body adjacent the lower end of the hub, the removal of said disc from said strainer body providing the hollow construction of said strainer body.

8. The sink strainer assembly of claim 3 wherein the upper head section of the nipple has a greater outer diameter than the interior diameter of a lower end of the hub section, wherein the lower threaded section of said nipple has lesser outside diameter than the diameter at the bottom of the hub section, and a transition section joining the outer periphery of the threaded lower section to the outer periphery of the upper head section, said transition section being in force-fit, liquid-tight engagement with the lower section of the hub to provide the force-fit, liquid-tight seal.

9. The sink strainer assembly of claim 8 wherein the outer periphery of each tab is close to the interior wall of the hub section to prevent each tab from moving out of its locking engagement with the filtering screen.

* * * * *